US006785646B2

(12) United States Patent
Wang et al.

(10) Patent No.: US 6,785,646 B2
(45) Date of Patent: Aug. 31, 2004

(54) METHOD AND SYSTEM FOR PERFORMING A CODEBOOK SEARCH USED IN WAVEFORM CODING

(75) Inventors: Yunbiao Wang, Fremont, CA (US); John Simons, San Mateo, CA (US)

(73) Assignee: Renesas Technology Corporation, Tokyo (JP)

( * ) Notice: Subject to any disclaimer, the term of this patent is extended or adjusted under 35 U.S.C. 154(b) by 659 days.

(21) Appl. No.: 09/855,821

(22) Filed: May 14, 2001

(65) Prior Publication Data

US 2003/0040905 A1 Feb. 27, 2003

(51) Int. Cl.[7] ..... G10L 19/12

(52) U.S. Cl. ..... 704/223; 704/262; 704/264; 704/219

(58) Field of Search ..... 704/222, 219, 704/223, 262, 264, 265

(56) References Cited

U.S. PATENT DOCUMENTS 5,717,824 A * 2/1998 Chhatwal ..... 704/222

6,073,092 A * 6/2000 Kwon ..... 704/219

* cited by examiner

*Primary Examiner*—Doris H. To
*Assistant Examiner*—Huyen Vo
(74) *Attorney, Agent, or Firm*—Townsend and Townsend and Crew LLP

(57) ABSTRACT

The present invention provides a method and system to improve the cookbook search algorithm used in a coding/decoding device or routine. The codebook search algorithm is performed by a processing system that allows for parallel execution of instructions, for example a DSP. An embodiment of the present invention provides a method for coding of a first waveform. First a plurality of vectors determined from a plurality of waveforms is stored in a memory. Next a minimum weighted error using a plurality of filter coefficients and the plurality of vectors is determined. The minimum weighted error gives a closest match between the first waveform and a second waveform synthesized from a selected vector of the plurality of vectors. Then an indication of said selected vector is provided as part of a code of the first waveform. The plurality of filter coefficients have added to them at least one duplicate filter coefficient such that the performance of determining the minimum weighted error is improved, by for example, at least one clock cycle.

26 Claims, 3 Drawing Sheets

METHOD AND SYSTEM FOR PERFORMING A CODEBOOK SEARCH USED IN WAVEFORM CODING

BACKGROUND OF THE INVENTION

The present invention relates generally to the compression/decompression of data and more particularly to improving the performance of the coding/decoding of waveforms, including speech.

Advances in technology has allowed waveforms, such as audio and speech, to be efficiently communicated in digital rather than analog format. Today there are many different types of codec's (coding/decoding circuits or software routines), which inputs a waveform, for example, speech, and outputs a series of codes. At the receiving side these codes are then used to reconstruct an approximation to the waveform.

There are generally three general types of coders: a vocoder, a waveform coder, and a hybrid coder. The first, vocoding, encodes information about how the speech signal was produced by the human vocal system. Vocoding uses techniques, for example Linear Predictive Coding (LPC), which determine parameters about how the speech was created and use these parameters to encode the waveform. While vocoding techniques can produce human understandable speech at very low bit rates, usually below 4.8 kbps, the reproduced speech signal often sounds quite synthetic. The second, waveform coding, tries to encode the waveform itself. An example of waveform encoding is Pulse Code Modulation (PCM) encoding. Waveform coding produces a decoded waveform that has the same general shape as the original. However, as information is lost using this procedure, waveform coders in general do not perform well at data rates below 16 kbps. The last, hybrid coders try to exploit the advantages of both vocoding and waveform techniques. A typical hybrid is an Analysis-by Synthesis coder. In order to code an original waveform such as speech, a codebook having vectors representing vector quantized waveforms is used to feed a synthesis filter which reconstructs an approximation of the original waveform. The index of the vector giving the reconstructed waveform with the closest match to the original waveform is then sent as the encoded waveform. Hybrids encode speech in such a way that results in a low data rate while keeping the speech intelligible. Typical bandwidth requirements lie between 4.8 and 16 kbps, inclusive.

One typical hybrid coder is a Code Excited Linear Predictive (CELP) coder (see CCITT Recommendation G.728 (1992), "Coding of speech at 16 kbit/s using low delay code excited linear prediction."). The G.728 codec can send encoded speech at about 16 kbits/s. The original waveform is partitioned into one or more sections called frames. Each frame is then quantized into a number of samples. For example, G.728 may use 20 samples representing about a 2.5 ms frame of speech and have synthesis filter parameters that are based on a high order short term linear predictor. In this example the frame may be represented by a 5 element vector, of which there are about 128 variations (or 7 bits). An index to a codebook gives a vector which is sent through the synthesis filter to give a reconstructed frame. This reconstructed frame is compared with the original frame and a weighted error is determined. The goal is to obtain the index with the minimum weighted error, for example, the minimum squared difference between the reconstructed frame associated with the index and the original frame. For the above G.728 example, 10 bits may be sent as a code for a frame with seven bits being the codebook index and the other three representing a gain. This conventional codebook search algorithm sequentially searches through the whole codebook, i.e., the index goes from 1 to N, where N is the number of vectors in the codebook. In the above G.728 example, N=128. This exhaustive search is computationally intensive, i.e., many clock cycles are used.

The widespread use of Digital Signal Processors (DSP's) in conjunction with the CPU has reduced the computational burden. A DSP may perform a plurality of instructions in parallel, i.e., during the same clock cycle. However, improvement in performance is still needed as the search is still computationally intensive. This is because there are many frames and each frame requires an exhaustive search through the codebook. In addition, these DSP's may have a small register set which complicates the task of having the DSP perform some or all of the computations.

Thus what is needed are techniques to further improve performance of the codebook search while taking into account the limitations on the number of DSP registers.

BRIEF SUMMARY OF THE INVENTION

The present invention provides a method and system to improve the cookbook search algorithm used in a coding/decoding device or routine. The codebook search algorithm is performed by a processing system that allows for parallel execution of instructions, for example a DSP. This permits the use of a memory location rather than a register to store the index to the codebook. As there is parallel data movement capability, modifications, for example, incrementing, of the codebook index can be stored in and retrieved from memory with minimal, if any, effect on the search performance. And another DSP register to maintain the above codebook index is not needed. The improvement of the algorithm by modifying the data structure having the filter coefficients and codebook index, results in a reduction of at least one clock cycle in the search algorithm.

An embodiment of the present invention provides a method for coding of a first waveform. First a plurality of vectors determined from a plurality of waveforms is stored in a computer readable medium, for example a volatile or non-volatile memory. Next a minimum weighted error using a plurality of filter coefficients and the plurality of vectors is determined. The minimum weighted error gives a closest match between the first waveform and a second waveform synthesized from a selected vector of the plurality of vectors. Then an indication of said selected vector is provided as part of a coding of the first waveform. The plurality of filter coefficients have added to them at least one duplicate filter coefficient such that the performance of determining the minimum weighted error is improved, by for example, at least one clock cycle.

Another embodiment of the present invention includes a method for improving a codebook search used in the encoding of a waveform, for example, speech, by a processor, for example, a DSP, where the codebook includes a plurality of vectors. First the method determines a data array including an array of filter coefficients. Next a first plurality of filter taps for a first vector is calculated. A filter tap is based on a filter coefficient and an element of a vector. A filter output is determined, using the first plurality of filter taps and a weighted error is then determined based on the filter output and a vectorized portion of the waveform. After a weighted error is calculated and a minimum error index determined, the process is repeated with a second plurality of filter taps being determined for a second vector, where at least one filter tap of the second plurality of filter taps is calculated in parallel when the weighted error associated with the first plurality of filter taps was determined.

These and other embodiments of the present invention are described in more detail in conjunction with the text below and attached figures.

DESCRIPTION OF THE SPECIFIC EMBODIMENTS

Figure 1:
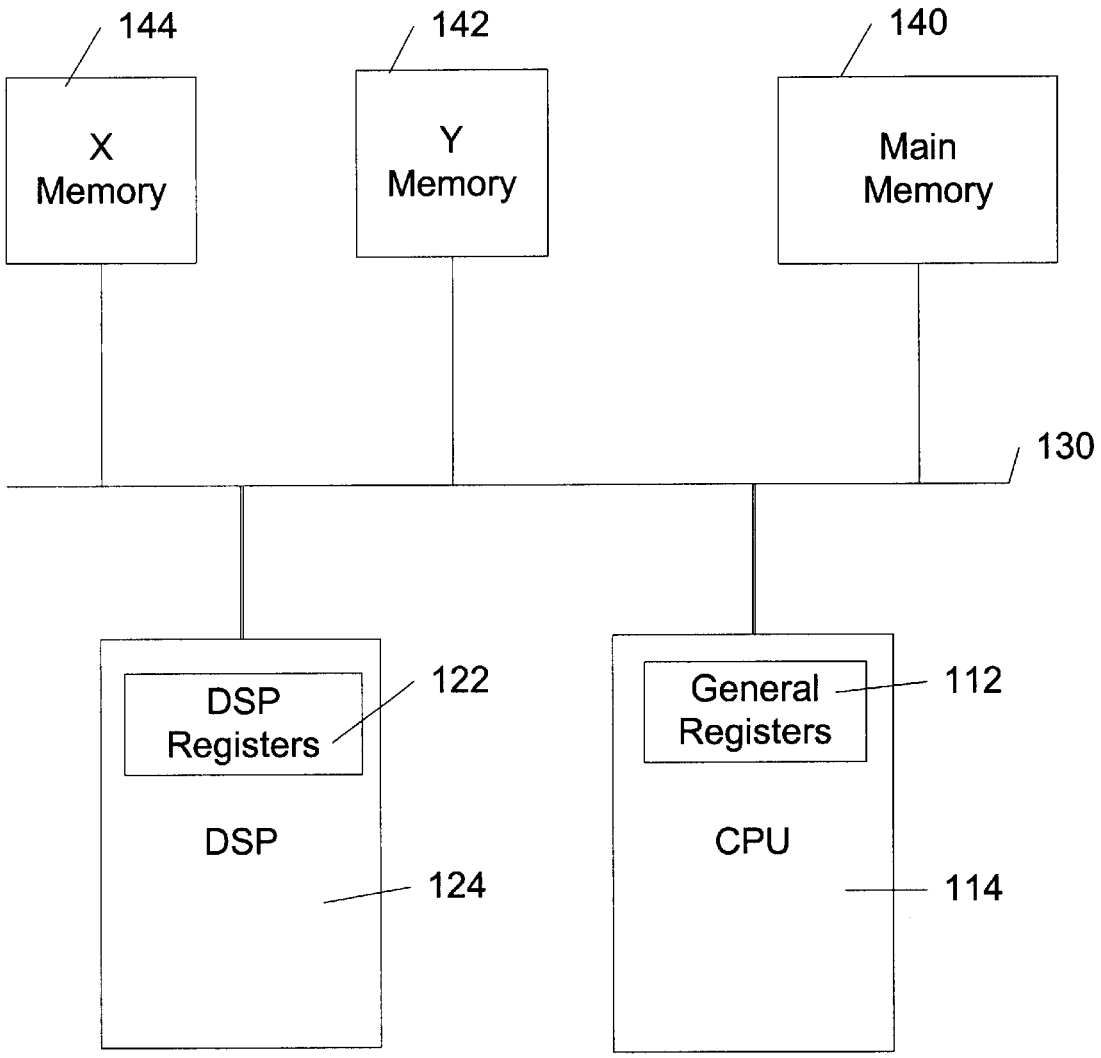
FIG. 1 shows a hardware system architecture for an embodiment of the present invention.

FIG. 1 shows a hardware system architecture for an embodiment of the present invention. The hardware architecture includes a CPU 114, embedded DSP 124, and three memories 140, 142, and 144. The CPU 114 includes general registers 112, including, for example, r1 to r9. The embedded DSP 124 includes DSP registers 122, including, for example, a0, a1, x0, x1, y0, y1 m0, and m1. The three memories include, for example, an X memory 144, a Y memory 142, and a main memory 140. The X and Y memories are typically used by the DSP 124 and the main memory 140 is typically used by the CPU 114. The X memory 144, Y Memory 142, and Main memory 140 are separated for illustration purposes only. In one embodiment each may be on separate devices. In other embodiments, the X and Y memories 144, 142 may be in one device or part of Main memory 140, or part of a separate DSP memory or part of the DSP 124 or the CPU 114. These three memories 140, 142, and 144 are connected to the CPU and DSP and to each other via a bus 130. The software programs and routines that are used by the DSP 124 are stored in one embodiment in main memory 140 and include parallel operation instructions, i.e., instructions that may be executed in parallel, for example, one clock cycle on the DSP 124. Examples of portions of code executed by DSP 124 in performing a CELP codebook search of an embodiment of this invention are given in Appendices A and B, which are herein incorporated by reference in their entirety.

An example of an embedded DSP is a SH-DSP produced by Hitachi, Ltd. of Tokyo Japan. Examples of DSP specific instructions that may be executed in parallel are illustrated in Table 1:

TABLE 1

| Instruction | Operation |
|---|---|
| pmuls Se, Sf, Dg | Se * 5f -> Dg (signed) |
| padd Sx, Sy, Dz | Sx + Sy -> Dz |
| psub Sx, Sy, Dz | Sx − Sy -> Dz |
| pcmp Sx, Sy | Sx − Sy -> Update DC (#1) |
| dcf pcopy Sx, Dz | If DC = 0, Sx -> Dz, If DC = 1, nop |
| dcf padd Sx, Sy, Dz | If DC = 0, Sx + Sy -> Dz, If DC = 1, nop |
| pinc Sx, Dz | MSW of Sx + 1 -> Dz |
| movx.w @ r4+, x0 | move from the contents of the address given in general register r4 in CPU 112 from X Memory 144 to DSP register 122 x0. Next increment the address in r4 by one. |
| movy.w @ r6+, y0 | move from the contents of the address given in general register r6 in CPU 112 from Y Memory 144 to DSP register 122 y0. Next increment the address in r6 by one. |

By examining Appendix A, some of the above instructions are used. Appendix A has a code snippet arranged in a table for ease of explanation (The same is true for the table format used in Appendix B). The code is a portion of an example of the code used to perform a known codebook search. There are line numbers (No.) from 1 to 27 and there are four columns, column 1 to 4. The instructions on the same line are executed in parallel by the SH-DSP generally in one clock cycle. However, labels such as loop 17_18*b* on line 3 and loop 17_18*e* on line 26 are not executable instructions and do not take a clock cycle. Also the instructions align 4 on line 2 and sts x1, r8 on line 17 may or may not take one clock cycle.

Figure 2:
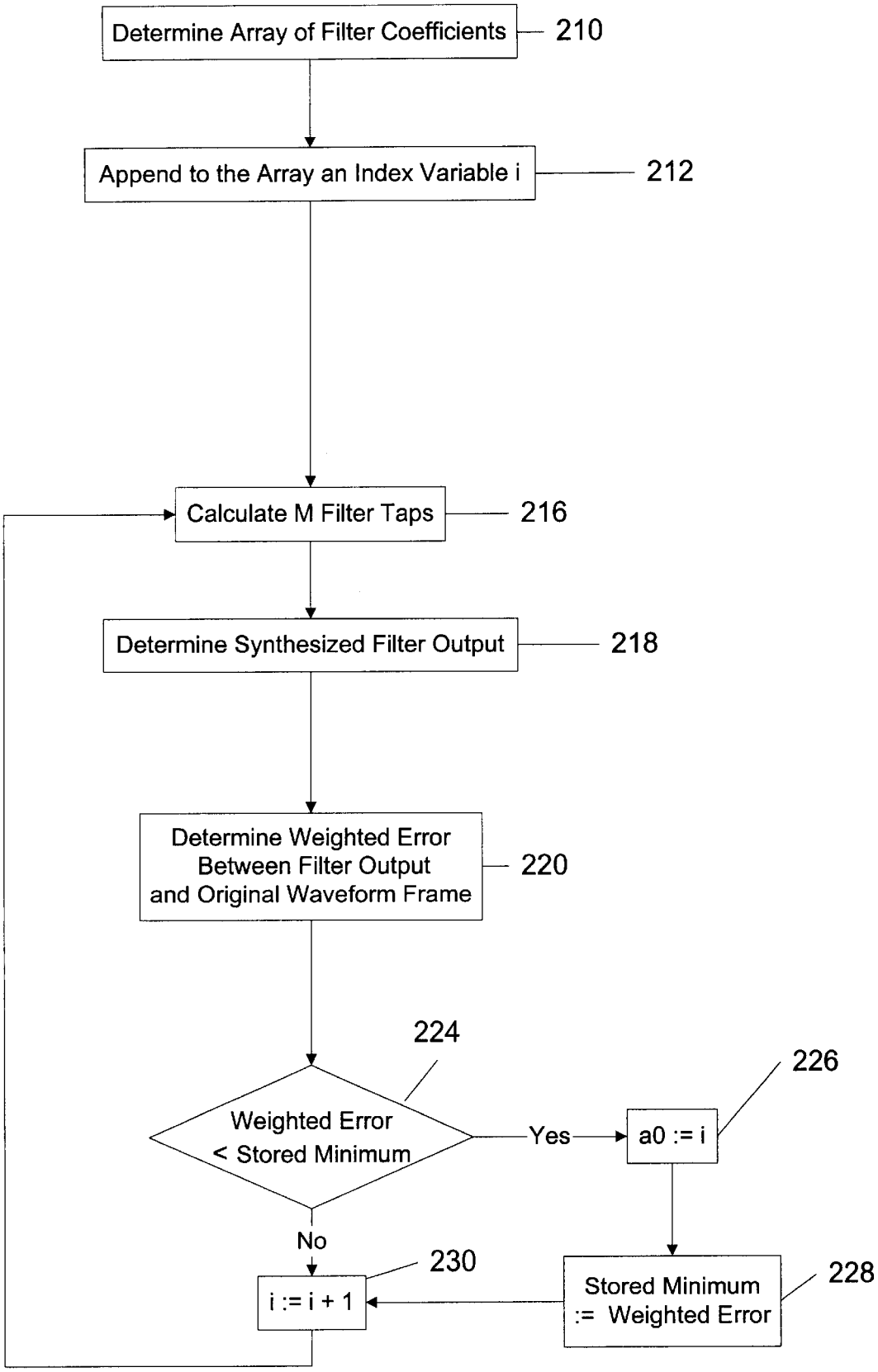
FIG. 2 shows a flowchart of an example of a known codebook search.

FIG. 2 shows a flowchart of an example of a known codebook search. At step 210 the data array having the "M" filter coefficients used by the synthesis filter in a CELP coder is determined. For illustration purposes, let M=5. Next, at step 212, an index variable "i" containing an index pointing to a codebook vector is appended to the data array. The result of the codebook search gives an index that is, for example, the seven bits used in the 10 bit code of the G.728 coder. Initially i=1, which is the index that points to the first code vector in the codebook. An example of the data array, i.e., filter array, is as follows:

$$[c1,c2,c3,c4,c5,i] \quad \text{[Eqn. 1]}$$

The above filter array is stored in Y Memory 142. The five filter coefficients, c1 to c5 remain constant as variable i is incremented from 1 to 128. CPU general register 112 r6 keeps the location of an element in the above filter array. "i" is a memory location that is used like an index register. Due to the parallelism of execution of instructions "i" can be loaded, incremented, and stored without any additional clock cycles. Thus a separate DSP register of the DSP registers 122 is not needed to maintain the index value into the codebook.

At step 216 the M filter taps are calculated, where in this example M=5. A filter tap is a multiplication of a filter coefficient stored in Y memory (DSP register r6) with a corresponding element of a vector from the codebook at address "i" in X memory (DSP register r4). Let the vector:

$$[v1(i), v2(i), v3(i), v4(i), v5(i)] \quad \text{[Eqn. 2]}$$

represent a codebook vector at index "i" given in the above filter array. An example filter tap is: c1*v1(i). While step 216 is being performed, step 218 determines the synthesized filter output. For example, the $$\text{Filter output}=c1*v1(i)+c2*v2(i)+c3*v3(i)+c4*v4(i)+c5*v5(i) \quad \text{[Eqn. 3]}$$

In FIG. 2 step 218 is shown after step 216, but in the code in Appendix A these two steps are done substantially in parallel. The relevant code from Appendix A is in an annotated Table 2, where columns have been added to show the X and Y memory data and the five calculated filter taps.

TABLE 2

| Line No. | column 1 | column 2 | filter taps | column 3 | code book | column 4 | filter coeff |
|---|---|---|---|---|---|---|---|
| 1 | | | | movx.w @r4+,x0 | v1 | movy.w @r6+,y0 | c1 |
| 2 | .align 4 | | | | | | |
| 3 | loop17 18b: | | | | | | |
| 4 | | pmuls x0,y0,a1 | tap 1 | movx.w @r4+,x0 | v2 | movy.w @r6+,y0 | c2 |
| 5 | | pmuls x0,y0,m0 | tap 2 | movx.w @r4+,x0 | v3 | movy.w @r6+,y0 | c3 |
| 6 | padd a1,m0,a1 | pmuls x0,y0,m0 | tap 3 | movx.w @r4+,x0 | v4 | movy.w @r6+,y0 | c4 |
| 7 | padd a1,m0,a1 | pmuls x0,y0,m0 | tap 4 | movx.w @r4+,x0 | v5 | movy.w @r6+,y0 | c5 |
| 8 | padd a1,m0,a1 | pmuls x0,y0,m0 | tap 5 | movx.w @r5+,x0 | | movy.w @r7+,y0 | |
| 9 | padd a1,m0,a1 | pmuls x0,y0,m0 | | | | | |

From Table 2 lines 4 to 8, the five filter taps are sequentially calculated and from lines 6 to 9 in column 1, the filter output is calculated.

At step 220 of FIG. 2 a weighted error, for example a squared difference, between the filter output and an output based on a vectorized frame of the original waveform is determined. Step 220 is done in lines 10 to 21 of Appendix A.

At step 224 the weighted error, e.g., DSP register x0, is compared with a stored minimum error value, e.g., DSP register m1. If the weighted error is less than the stored minimum, then at step 226 DSP register a0 gets the new index i associated with the lower error. Next at step 228 the stored minimum, e.g., DSP register m1, gets the weighted error, e.g. x0. Steps 224 to 228 are covered by lines 24 to 27 in Appendix A.

At step 230 index i is incremented and stored in Y memory 142 and the flowchart goes to step 216 to repeat the search for the next vector in the codebook. When the loop has been iterated about 128 times (not shown), DSP register a0 has the index of the codebook vector with the minimum weighted error. The seven bits in DSP register a0 are part of the code that is sent for this frame of the original waveform. Step 230 is shown in Appendix A by line 23 incrementing the index, and line 25, column 4, storing the contents of DSP register al in "i" of the filter array in Y memory 142.

Comparing the code, lines 20–21, in Appendix A (Table 3)with the code in Appendix B (Table 4), the empty instruction areas represented by asterisks *, , and * in Table 3 could be filled with the corresponding instructions given in Table 4. However, in line 21, column 3 (movy.w @ r6, y0), CPU register r6 points to index "i." Thus not until line 25, column 4 (movy.w al, @ r6+r9, resetting r6 to position 1 in the filter array) and line 27 column 4 (movy.w @ r6+, y0), does DSP register y0 get c1. And only until the next iteration at line 4 column 2 (pmuls x0, y0, a1) in Table 2 can tap 1 be calculated.

TABLE 3

| from Appendix A | | | | |
|---|---|---|---|---|
| 20 | | pmuls x0, y0, a1 | ** | *** |
| 21 | psub a1, m0, x0 | * | movy.w @ r6, y0 | |

TABLE 4

| from Appendix B | | | | |
|---|---|---|---|---|
| 20 | | pmuls x0, y0, a1 | **movx.w @ r4+, x0 | ***movy.w @ r6+, y0 |
| 21 | psub a1, m0, x0 | *pmuls x0, y0, m0 | movy.w @ r6, y0 | |

In a preferred embodiment of the present invention the data array has at least one duplicated first element. This allows for the use of the one or more filter taps in the present iteration to be calculated in one or more past iterations with substantially no increase in clock cycles. For example, in the case of Eqn. 1 above, the data array with the five filter coefficients and index i is modified so that the first five elements are the same as before and the first element is duplicated at the sixth position and the index i is at the seventh position. Thus the new data array is:

$$[c1,c2,c3,c4,c5,c1,i] \quad \text{[Eqn. 4]}$$

Now if the instructions in Table 4 with the asterisks are put in Table 3, y0 in line 20 (movy.w @ r6+, y0) points to position 6 in the data array [Eqn. 4], i.e., c1. Thus in line 21 tap 1 (pmuls x0, y0, m0) for the next iteration can be calculated. This implies that Appendix A can be modified to remove line 4 having pmuls x0, y0, a1 from the iterative loop. This should reduce, except for the first iteration, the N−1 iterations (steps 216 to 230) by one clock cycle per iteration. Thus N−1 clock cycles may be saved.

Figure 3:
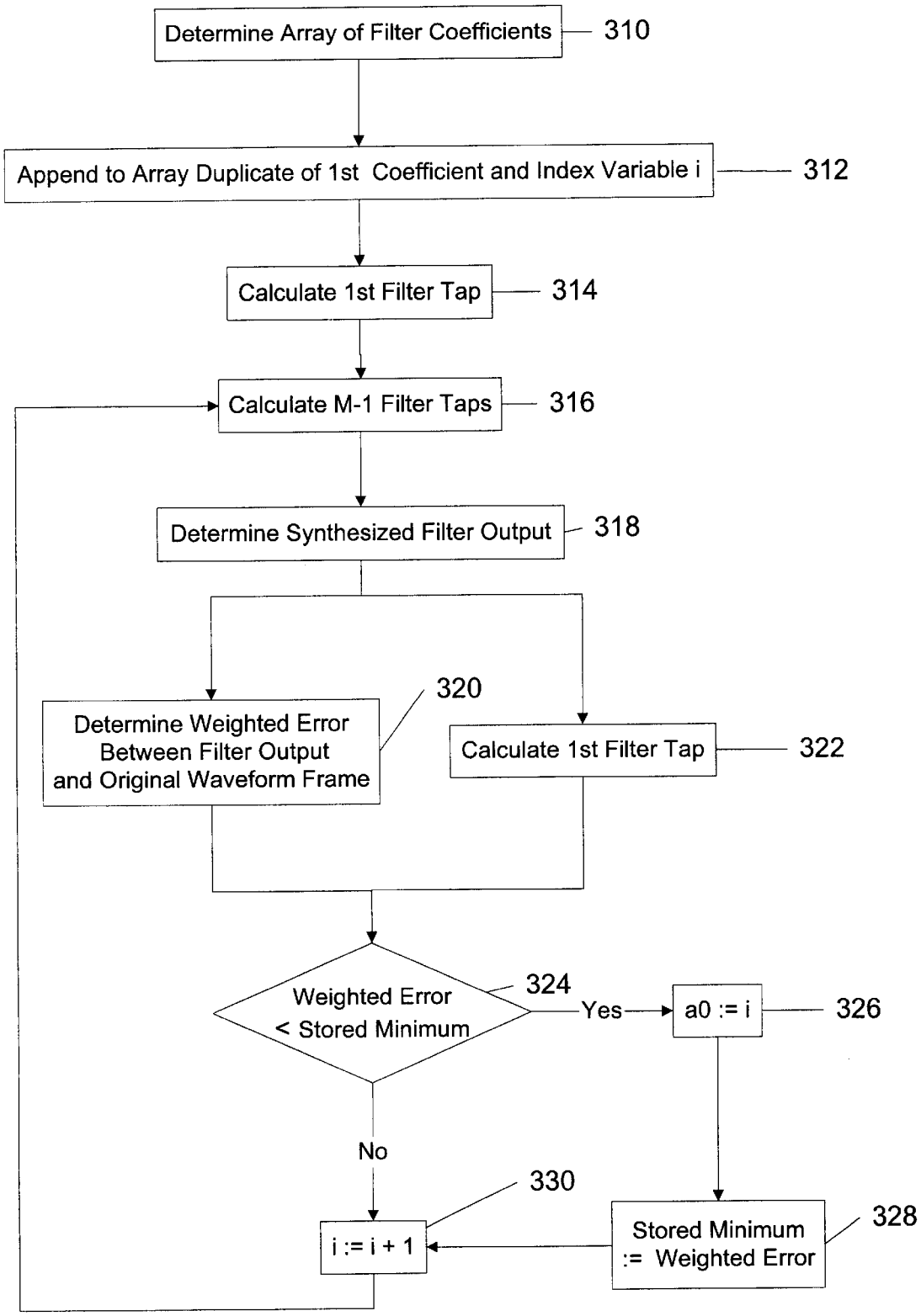
FIG. 3 gives a flowchart showing the improved codebook search routine of an embodiment of the present invention.

FIG. 3 gives a flowchart showing the improved codebook search routine of an embodiment of the present invention. At step 310 the filter coefficients, for example, c1 to c5, are determined. Next a duplicate of the first coefficient, for example, c1, and the index memory location "i" are appended to the array of filter coefficients (step 312), for example [Eqn. 4] above. At step 314 the first filter tap, for example, c1*v1(i), is calculated (line 4, col. 2 of Appendix B, pmuls x0, y0, m0). Step 316 begins the iterative loop to determine the index which gives the minimum weighted error in the codebook; at step 316 the M−1, for example M=5, filter taps are calculated, for example, c2*v2(i), c3*v3(i), c4*v4(i), and c5*v5(i). At step 318 the synthesized filter output vector, for example [Eqn. 3], is determined. Steps 316 and 318 may be executed in parallel in one embodiment. In an alternative embodiment steps 316 and 318 may be executed sequentially. At step 320 a weighted error value, for example, a squared difference, is determined between the filter output vector calculated at step 318 and a vector determined from the original waveform frame. In parallel to the calculation done at step 320, the first filter tap for the next iteration, for example, c1*v1(i+1), is calculated at step 322 (see lines 20 and 21 of Appendix B). The weighted error value calculated in step 320 is then compared to a stored minimum error value (step 324). If the weighted error is less than the stored minimum then the stored minimum is replaced by the weighted error value (step 328). DSP register a0 gets index value i (step 326). Register a0 keeps the current index that has the minimum weighted error. Step 330 either follows step 328, or if the weighted error is not less than the stored minimum, then index i is incremented by one, (i:=i+1) and the loop returns to step 316 to evaluate the next code vector (i+1) in the codebook. The steps 316 to 330, inclusive, are repeated for every entry in the codebook and the final result is the index having the codebook vector with the minimum weighted error from the original waveform frame, this index (in a0) then becomes part of the code for the frame.

Appendix B has an example of SH-DSP assembly code which has been modified from Appendix A to reflect the embodiment in FIG. 3. One major difference is that line 4, in Appendix A:

| | | | |
|---|---|---|---|
| 4 | pmuls x0, y0, a1 | movx.w @ r4+, x0 | movy.w @ r6+, y0 |

that calculates the first filter tap, has been moved outside the loop in Appendix B. An example of the operation of lines 1–9 of Appendix B is shown in Table 5 below (with the same variables used in Table 2 above).

TABLE 5

| Line No. | column 1 | column 2 | filter taps | column 3 | code book | column 4 | filter coeff |
|---|---|---|---|---|---|---|---|
| 1 | | | | movx.w @r4+,x0 | v1 | movy.w @r6+,y0 | c1 |
| 2 | | pmuls x0,y0,a1 | tap 1 | movx.w @r4+,x0 | v2 | movy.w @r6+,y0 | c2 |
| 3 | .align 4 | | | | | | |
| 4 | loop17 18b: | | | | | | |
| 5 | | pmuls x0,y0,m0 | tap 2 | movx.w @r4+,x0 | v3 | movy.w @r6+,y0 | c3 |
| 6 | padd a1,m0,a1 | pmuls x0,y0,m0 | tap 3 | movx.w @r4+,x0 | v4 | movy.w @r6+,y0 | c4 |
| 7 | padd a1,m0,a1 | pmuls x0,y0,m0 | tap 4 | movx.w @r4+,x0 | v5 | movy.w @r6+,y0 | c5 |
| 8 | padd a1,m0,a1 | pmuls x0,y0,m0 | tap 5 | movx.w @r5+,x0 | | movy.w @r7+,y0 | |
| 9 | padd a1,m0,a1 | pmuls x0,y0,m0 | | | | | |

As can be seen from Table 4 above the calculation of the first filter tap for the next iteration, e.g., c1*v1(i+1), is done in iteration "i" without taking an additional clock cycle. Table 6 shows an illustration of the values calculated. Note at line 20 column 6 (movy.w @ r6+, y0), DSP register r6 points to position 6. which in the array of [Eqn. 4] is c1. And at line 21 column 3, (movy.w @ r6, y0), r6 points to "i."

TABLE 6

| Line No. | column 1 | column 2 | filter taps | column 3 | code book | column 4 | filter coeff |
|---|---|---|---|---|---|---|---|
| 20 | | pmuls x0,y0,a1 | | movx.w @r4+,x0 | v1 (i+1) | movy.w @r6+,y0 | c1 |
| 21 | psub a1,m0,x0 | pmuls x0,y0,m0 | tap 1 (i+1) | movy.w @r6, y0 | | movy.w @r6+,y0 | |

Thus the iterative loop from Appendix A has lines 3 to 27 and Appendix B has lines 4 to 27. For the first time through, both the code in Appendix A and the code in Appendix B take substantially the same amount of time. However, for the rest of the, for example, (N−1)=127, iterations, Appendix B uses one less clock cycle in each iteration. Thus the larger the codebook the more time is saved.

One of the major advantages of this embodiment of the present invention is the improvement in performance by the saving of clock cycles in waveform, for example speech, encoding.

Although the above functionality has generally been described in terms of specific hardware and software, it would be recognized that the invention has a much broader range of applicability. For example, the software functionality can be further combined or even separated. Similarly, the hardware functionality can be further combined, or even separated. The software functionality can be implemented in terms of hardware or a combination of hardware and software. Similarly, the hardware functionality can be implemented in software or a combination of hardware and software. Any number of different combinations can occur depending upon the application.

While various embodiments have been described with respect to the present invention, it is to be understood that modifications will be apparent to those skilled in the art without departing from the spirit of the invention; for example, embodiments of the present invention can also apply to other codebook applications, for example, waveform coding using vector quantization, were a memory location is used as an index into the codebook. The present invention is not limited only to those embodiments described above.

APPENDIX A

SH-DSP ASSEMBLY CODE

| Line No. | column 1 | column 2 | column 3 | column 4 |
|---|---|---|---|---|
| 1 | | | movx.w @ r4+, x0 | movy.w @ r6+, y0 |
| 2 | .align 4 | | | |
| 3 | loop17_18b: | | | |
| 4 | | pmuls x0, y0, a1 | movx.w @ r4+, x0 | movy.w @ r6+, y0 |
| 5 | | pmuls x0, y0, m0 | movx.w @ r4+, x0 | movy.w @ r6+, y0 |
| 6 | padd a1, m0, a1 | pmuls x0, y0, m0 | movx.w @ r4+, x0 | movy.w @ r6+, y0 |
| 7 | padd a1, m0, a1 | pmuls x0, y0, m0 | movx.w @ r4+, x0 | movy.w @ r6+, y0 |
| 8 | padd a1, m0, a1 | pmuls x0, y0, m0 | movx.w @ r5+, x0 | movy.w @ r7+, y0 |
| 9 | padd a1, m0,al | pmuls x0, y0, m0 | | |
| 10 | pabs a1, a1 | movx.w @ r5+, x0 | | |
| 11 | psub a1, m0, x0 | pmuls x0, y0, m0 | | |
| 12 | dct padd x1, yl, x1 | | movx.w @ r5+, x0 | |
| 13 | psub a1, m0, x0 | pmuls x0, y0, m0 | | |
| 14 | dct padd x1, y1, x1 | | | |
| 15 | psub a1, m0, x0 | | | |
| 16 | dct padd x1, y1, x1 | | | |
| 17 | sts x1, r8 | | | |
| 18 | psha #1, a1 | | movx.w @ r5 + r8, x0 | |
| 19 | | pmuls x0, a1, m0 | movx.w @ r5, x0 | |
| 20 | | pmuls x0, y0, a1 | | |
| 21 | psub a1, m0, x0 | | movy.w @ r6, y0 | |
| 22 | mov r10, r5 | | | |
| 23 | pinc y0, a1 | | | |
| 24 | pcmp x0, m1 | | | |
| 25 | dcf pcopy x0, m1 | | movx.w @ r4+, x0 | movy.w a1, @ r6 + r9 |
| 26 | loop17_18e: | | | |
| 27 | dcf padd x1, y0, a0 | | movx.w @ r5+, x1 | movy.w @ r6+, y0 |

APPENDIX B

REVISED SH-DSP ASSEMBLY CODE

| Line No. | column 1 | column 2 | column 3 | column 4 |
|---|---|---|---|---|
| 1 | | | movx.w @ r4+, x0 | movy.w @ r6+, y0 |
| 2 | | pmuls x0, y0, m0 | movx.w @ r4+, x0 | movy.w @ r6+, y0 |
| 3 | .align 4 | | | |
| 4 | loop17_18b: | | | |
| 5 | | pmuls x0, y0, a1 | movx.w @ r4+, x0 | movy.w @ r6+, y0 |
| 6 | padd a1, m0, a1 | pmuls x0, y0, m0 | movx.w @ r4+, x0 | movy.w @ r6+, y0 |
| 7 | padd a1, m0, a1 | pmuls x0, y0, m0 | movx.w @ r4+, x0 | movy.w @ r6+, y0 |
| 8 | padd al ,m0, a1 | pmuls x0, y0, m0 | movx.w @ r5+, x0 | movy.w @ r7+, y0 |
| 9 | padd a1, m0, a1 | pmuls x0, y0, m0 | | |
| 10 | pabs a1, a1 | | movx.w @ r5+, x0 | |
| 11 | psub a1, m0, x0 | pmuls x0, y0, m0 | | |
| 12 | dct padd x1, y1, x1 | | movx.w @ r5+, x0 | |
| 13 | psub a1, m0, x0 | pmuls x0, y0, m0 | | |
| 14 | dct padd x1, y1, x1 | | | |
| 15 | psub a1, m0, x0 | | | |
| 16 | dct padd x1, y1, x1 | | | |
| 17 | sts x1, r8 | | | |
| 18 | psha #1, a1 | | movx.w @ r5 + r8, x0 | |
| 19 | | pmuls x0, a1, m0 | movx.w @ r5, x0 | |
| 20 | | pmuls x0, y0, a1 | movx.w @ r4+, x0 | movy.w @ r6+, y0 |
| 21 | psub a1, m0, x0 | pmuls x0, y0, m0 | movy.w @ r6, y0 | |

APPENDIX B-continued

REVISED SH-DSP ASSEMBLY CODE

| Line No. | column 1 | column 2 | column 3 | column 4 |
|---|---|---|---|---|
| 22 | mov r10, r5 | | | |
| 23 | pinc y0, a1 | | | |
| 24 | pcmp x0, m1 | | | |
| 25 | dcf pcopy x0, m1 | | movx.w @ r4+, x0 | movy.w a1, @ r6 + r9 |
| 26 | loop17_18e: | | | |
| 27 | dcf padd x1, y0, a0 | | movx.w @ r5+, x1 | movy.w @ r6+, y0 |

What is claimed is:

1. A method for providing coding of a first waveform comprising:

storing in a computer readable medium a plurality of vectors determined from a plurality of waveforms;

determining a minimum weighted error using a plurality of filter coefficients and said plurality of vectors, wherein said minimum weighted error gives a closest match between said first waveform and a second waveform synthesized from a selected vector of said plurality of vectors; and providing an indication of said selected vector as a part of a coding of said first waveform; and wherein a duplicate filter coefficient of at least one filter coefficient of said plurality of filter coefficients is added to said plurality of filter coefficients such that performance of said determining said minimum weighted error is improved.

2. The method of claim 1 wherein said plurality of vectors are part of a codebook.

3. The method of claim 2 wherein said codebook is a Code Excited Linear Prediction (CELP) codebook.

4. The method of claim 2 wherein said indication is an index in said codebook.

5. The method of claim 1 wherein said first waveform includes speech.

6. The method of claim 1 wherein said determining a minimum weighted error uses an analysis-by-synthesis technique.

7. The method of claim 1 wherein said determining a minimum weighted error uses Code Excited Linear Prediction (CELP).

8. The method of claim 1 wherein said performance of said determining said minimum weighted error is improved by at least one clock cycle.

9. The method of claim 1 wherein said determining said minimum weighted error is determined using a software routine on a Digital Signal Processor (DSP).

10. The method of claim 1 wherein said determining said minimum weighted error evaluates at least two vectors of said plurality of vectors concurrently.

11. The method of claim 1 wherein said plurality of filter coefficients further comprises a loop counter, said loop counter stored in a non-register memory.

12. A method for improving performance of a Code Excited Linear Prediction (CELP) speech routine by decreasing time needed to perform a codebook search, said routine operated on by a processor, wherein a plurality of instructions of said routine execute in parallel, said method comprising the steps of:

(a) storing in memory a data structure comprising a plurality of filter coefficients, a duplicate of a filter coefficient of said plurality of filter coefficients, and an index;

(b) determining a vector in a CELP codebook, associated with said index;

(c) determining a weighted error based on a plurality of filter taps and a vector associated with the original waveform, said plurality of filter taps based on said vector and said plurality of filter coefficients, wherein said weighted error is a minimum weighted error, when said weighted error is less than a previous weighted error;

(d) using said duplicate, calculating a filter tap to be used when step (c) is repeated;

(e) incrementing said index; and (f) repeating steps (b) to (e).

13. A method for improving a codebook search used in encoding of a waveform by a processor, wherein said codebook comprises a plurality of vectors, said method comprising:

determining a data array including an array of filter coefficients;

calculating a first plurality of filter taps for a first vector of said plurality of vectors, wherein a filter tap of a plurality of filter taps is based on a filter coefficient of said array of filter coefficients and an element of a vector of said plurality of vectors;

determining a filter output, using said first plurality of filter taps;

determining a weighted error based on said filter output and a portion of said waveform; and determining a second plurality of filter taps for a second vector of said plurality of vectors, wherein at least one filter tap of said second plurality of filter taps is calculated in parallel with said determining a weighted error.

14. The method of claim 13 further comprising:

evaluating each weighted error for each vector of said plurality of vectors to determine an index associated with an evaluated vector having a minimum weighted error; and using said index as a part of a code for said portion of said waveform.

15. The method of claim 13 wherein said processor is a DSP.

16. The method of claim 13 wherein said waveform includes speech.

17. The method of claim 13 wherein said portion is a frame.

18. The method of claim 13 wherein said data array further includes an index variable and a duplicate filter coefficient of one filter coefficient of said array of filter coefficients.

19. The method of claim 13 wherein said array of filter coefficients is associated with a short term linear predictor.

20. A system for performing low delay Code Excited Linear Predictive (CELP) coding of speech, said system comprising:

a first memory storing a vector in a codebook, said codebook comprising a plurality of vectors;

a second memory comprising a data structure including an index associated with said vector, filter coefficients for a synthesis filter and a duplicate of a first of said filter coefficients; and a Digital Signal Processor (DSP) for determining a specific index with an associated vector in said codebook having a minimum error between an output of said synthesis filter using said associated vector and a vectorized part of said speech.

21. The method of claim 20 wherein said specific index is a seven bit code.

22. The method of claim 20 wherein said CELP coding is compliant with a G.728 ITU standard.

23. The method of claim 20 wherein said synthesis filter includes a high order short term linear predictor.

24. The method of claim 20 wherein said duplicate of said first of said filter coefficients allows a subtraction instruction and a multiplication instruction to be executed in one clock period.

25. The method of claim 24 wherein said multiplication instruction calculates a first filter tap.

26. A computer program product stored in a computer readable medium for improving a codebook search used in an encoding of a waveform by a processor, wherein said codebook comprises a plurality of vectors, said computer program product comprising:

code for determining a data array including an array of filter coefficients;

code for calculating a first plurality of filter taps for a first vector of said plurality of vectors, wherein a filter tap of a plurality of filter taps is based on a filter coefficient of said array of filter coefficients and an element of a vector of said plurality of vectors;

code for determining a filter output, using said first plurality of filter taps;

code for determining a weighted error based on said filter output and a portion of said waveform; and code for determining a second plurality of filter taps for a second vector of said plurality of vectors, wherein at least one filter tap of said second plurality of filter taps is calculated in parallel with said determining a weighted error.

* * * * *